United States Patent [19]

Esposito et al.

[11] Patent Number: 4,851,147

[45] Date of Patent: Jul. 25, 1989

[54] TRANSPARENT COMBINATION SOAP-SYNTHETIC DETERGENT BAR

[75] Inventors: Michael A. Esposito, Randolph, N.J.; Mario Novakovic, Kew Garden Hills, N.Y.

[73] Assignee: Finetex, Inc., Elmwood Park, N.J.

[21] Appl. No.: 19,358

[22] Filed: Feb. 26, 1987

[51] Int. Cl.[4] ..... C11D 9/26; C11D 9/04

[52] U.S. Cl. ..... 252/108; 252/DIG. 16; 252/132; 252/118

[58] Field of Search ..... 252/DIG. 16, 122, 132, 252/108, 118, DIG. 5

[56] References Cited

U.S. PATENT DOCUMENTS

| | | | |
|---|---|---|---|
| 1,626,708 | 5/1927 | Villain | 252/122 |
| 1,887,743 | 11/1932 | Villain | 252/368 |
| 2,005,160 | 6/1935 | Pape | 37/16 |
| 2,820,768 | 1/1958 | Fromont | 252/118 |
| 2,894,912 | 7/1959 | Geitz | 252/121 |
| 2,970,116 | 1/1961 | Kelly et al. | 252/368 |
| 3,155,624 | 11/1964 | Kelly | 252/122 |
| 3,274,911 | 9/1966 | Goldwasser et al. | 252/368 |
| 3,376,229 | 4/1968 | Haass et al. | 252/117 |
| 3,520,816 | 7/1970 | de Acetis et al. | 252/108 |
| 3,562,167 | 2/1971 | Kamen et al. | 252/121 |
| 3,741,911 | 6/1973 | Shane | 252/527 |
| 3,789,011 | 1/1974 | Tanaka | 252/367 |
| 3,793,214 | 2/1974 | O'Neill | 252/117 |
| 3,864,272 | 2/1975 | Toma et al. | 252/125 |
| 3,879,309 | 4/1975 | Gatti et al. | 252/117 |
| 3,903,008 | 9/1975 | Deweever et al. | 252/118 |
| 3,926,828 | 12/1975 | O'Neill et al. | 252/117 |
| 3,969,259 | 7/1976 | Lages | 252/107 |
| 4,165,293 | 8/1979 | Gordon | 252/118 |

(List continued on next page.)

FOREIGN PATENT DOCUMENTS

| | | |
|---|---|---|
| 651026 | 1/1965 | Belgium . |
| 2622841 | 12/1977 | Fed. Rep. of Germany . |
| 3330113 | 3/1984 | Fed. Rep. of Germany . |
| 3330115 | 3/1984 | Fed. Rep. of Germany . |
| 44483 | 1/1966 | German Democratic Rep. . |

(List continued on next page.)

OTHER PUBLICATIONS

"Akypo", undated, p. 2.

Transparent Soap—E. T. Webb, Amer. Perfumer Cosmet. 82(4), 41–4(1967)(Eng).

Transparent Soaps—Dieter Osteroth Dragoco Rep.(Ger. Fragrance Ed.) 1979, 26(11–12), 267–75.

Transparent-Soap Manufacture in India—Japan Kumar Das Indian Soap J. 22, 78–85(1956).

*Primary Examiner*—John F. Niebling

*Assistant Examiner*—Isabelle Rodriquez

*Attorney, Agent, or Firm*—Weingram & Zall

[57] ABSTRACT

A transparent soap bar containing soap and a water soluble synthetic detergent comprising:

(a) a water soluble organic solvent, about 0 to 10%;

(b) a sugar, about 0 to 10%;

(c) an alkyl-aryl polyoxyalkylene carboxylic acid of the formula:

wherein R is an aryl, alkyl-aryl or alkyl radical, $R_1$ through $R_6$ are each hydrogen or a lower alkyl radical and may be the same or different, m is 1 to 3 and n is 1 to 9, about 1% to 10%;

(d) a benzoic acid ester of a primary alcohol or alkoxylate of a primary alcohol, said alcohol of $C_9$ to $C_{18}$ carbon chain length, about 0 to 5%;

(e) the water soluble synthetic organic detergent, up to about 15%;

(f) a neat soap, about 0 to 60%;

(g) a fatty acid, about 1% to about 25%;

(h) a saponifying or neutralizing agent for the fatty acid, about 3% to about 35%;

(i) ethylene diamine tetra-acetic acid, about 0 to 2%; and (j) water, about 0 to 25%.

21 Claims, 1 Drawing Sheet

U.S. PATENT DOCUMENTS

| | | | |
|---|---|---|---|
| 4,198,311 | 4/1980 | France et al. | 252/117 |
| 4,206,069 | 6/1980 | Borrello | 252/122 |
| 4,234,464 | 11/1980 | Morshauser | 252/544 |
| 4,256,600 | 3/1981 | Lewis | 252/132 |
| 4,275,222 | 6/1981 | Scala, Jr. | 560/103 |
| 4,278,655 | 7/1981 | Elmi | 424/47 |
| 4,290,904 | 9/1981 | Poper et al. | 252/118 |
| 4,293,544 | 10/1981 | Elmi | 424/60 |
| 4,297,230 | 10/1981 | Rasser | 252/117 |
| 4,322,545 | 3/1982 | Scala, Jr. | 560/103 |
| 4,323,693 | 4/1982 | Scala, Jr. | 560/103 |
| 4,323,694 | 4/1982 | Scala | 560/103 |
| 4,443,353 | 4/1984 | Van Paassen | 252/103 |
| 4,468,338 | 8/1984 | Lindberg | 252/105 |
| 4,490,280 | 12/1984 | Joshi et al. | 252/368 |
| 4,493,786 | 1/1985 | Joshi | 252/368 |
| 4,584,126 | 4/1986 | Joshi | 252/368 |
| 4,612,136 | 9/1986 | Novakovic | 252/134 |

FOREIGN PATENT DOCUMENTS

| | | |
|---|---|---|
| 47-13608 | 7/1972 | Japan . |
| 48-08304 | 2/1973 | Japan . |
| 48-42935 | 12/1973 | Japan . |
| 49-28645 | 7/1974 | Japan . |
| 51-14907 | 2/1976 | Japan . |
| 51-24606 | 2/1976 | Japan . |
| 51-73505 | 6/1976 | Japan . |
| 54-24905 | 2/1979 | Japan . |
| 55-25465 | 2/1980 | Japan . |
| 56-16800 | 9/1981 | Japan . |
| 57-30798 | 2/1982 | Japan . |
| 57-42800 | 3/1982 | Japan . |
| 57-49700 | 3/1982 | Japan . |
| 57-185398 | 11/1982 | Japan . |
| 57-61079 | 12/1982 | Japan . |
| 58-07499 | 1/1983 | Japan . |
| 58-53997 | 3/1983 | Japan . |
| 58-53998 | 3/1983 | Japan . |
| 58-162700 | 9/1983 | Japan . |
| 58-208393 | 12/1983 | Japan . |
| 59-75999 | 4/1984 | Japan . |
| 59-161499 | 9/1984 | Japan . |
| 59-204698 | 11/1984 | Japan . |
| 60-13899 | 1/1985 | Japan . |
| 60-79097 | 5/1985 | Japan . |
| 60-112896 | 6/1985 | Japan . |
| 60-181199 | 9/1985 | Japan . |
| 60-188500 | 9/1985 | Japan . |
| 6402057 | 9/1964 | Netherlands . |
| 1460442 | 1/1977 | United Kingdom . |

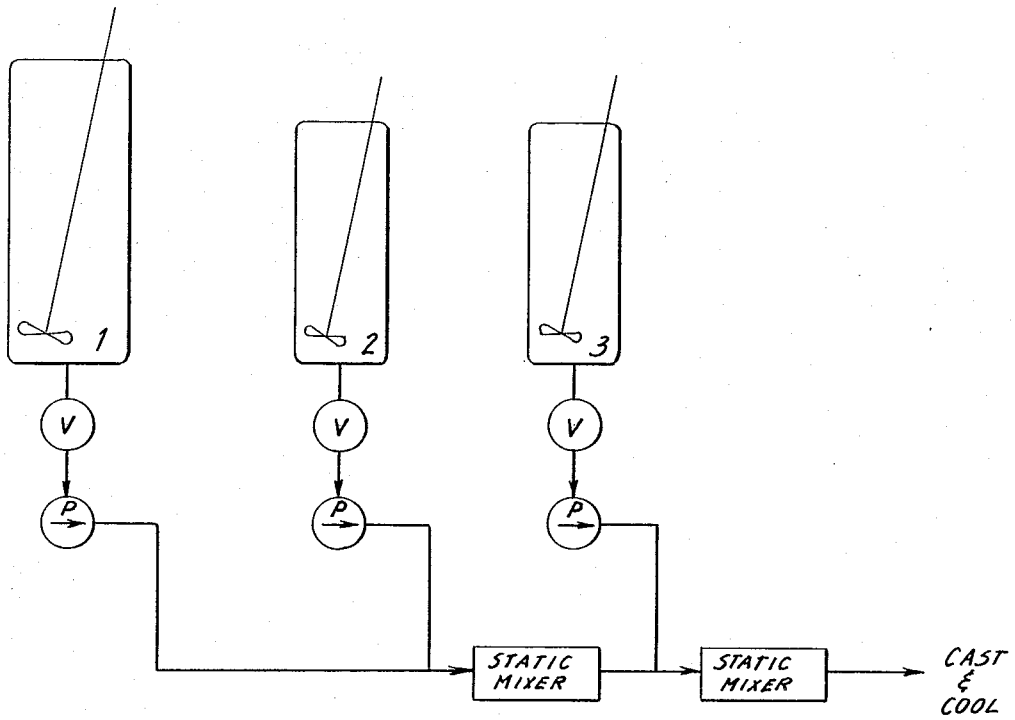
1: HOLDING & HEATING TANK FOR (f)
2: HOLDING & HEATING TANK FOR (a-d) & (h)
3: HOLDING & HEATING TANK FOR (e) & (g)

TRANSPARENT COMBINATION SOAP-SYNTHETIC DETERGENT BAR

BACKGROUND OF THE INVENTION

1. Field of the Invention

This invention relates to transparent soap bars and liquids and methods for production thereof by batch or continuous processes. More particularly, this invention relates to making transparent soap bars and liquids which contain synthetic detergents, i.e. a "combo-bar".

2. Prior Art

Transparent soaps, and methods for their manufacture, have been well known and available for a great many years. Being costly to manufacture, they have been generally regarded as luxury items, and their properties have been equated with high purity and neutrality (although they may actually contain free alkali). Such products have been used almost exclusively in the toilet articles area, i.e. bathing, hand and face washing, etc.

Numerous transparent soaps have been formulated. A classic method involves the low temperature saponification of fats and oils predissolved in warm alcohol, water and glycerine, followed by evaporation of part of the alcohol/water azeotrope. Another common technique is based upon the addition of a polyhydric alcohol, such as glycerol, glycol, sugar or the like to a "neat soap" or semi-boiled soap, or to soap prepared by the cold process technique. Still another method consists of dissolving soap in alcohol to solubilize certain components and then distilling off most of the alcohol.

U.S. Pat. No. 3,562,167 to *Kamen* describes a transparent soap formed from a combination of soap, polyhydric alcohol and, as a surface-active agent, a polyalkoxy ether of an alkylphenol.

U.S. Pat. No. 3,903,008 to *Deweever et al.* describes the formulation of a transparent soap by the combination of soap, polyhydric alcohols and a quaternized dihydroimidazole detergent.

U.S. Pat. Nos. 3,793,214 and 3,926,828 to *O'Neil et al.* describe transparent soaps produced using branched chain fatty acids. U.S. Pat. No. 3,864,272 to *Toma et al.* describes the use of a rather complicated, elaborate mechanical method of working the soap, i.e. spray drying followed by mechanical working.

A method of formulating a transparent soap is disclosed in U.S. Pat. No. 2,820,768 where a sodium soap made from tallow, coconut oil and castor is mixed with a triethanolamine soap of stearic acid an oleic acid and an excess of the amine.

U.S. Pat. No. 4,290,904 describes a transparent low alkalinity bar soap based on a tetrakis (hydroxyalkyl) ethylene diamine.

Numerous other transparent soap bars are also known in the art, see, for example, Applicants' Information Disclosure filed herewith and incorporated herein by reference.

One of the disadvantages of these prior art transparent soap bars is that they form the typical scum in hard water. In order to overcome this problem with soaps in general, not only in transparent soaps, synthetic detergents were developed. It has been found, however, that when these synthetic detergents were added to the typical transparent soap to form what is called a "combo-bar" (i.e. a combination of synthetic detergent and soap), that the bar is no longer transparent. To the Inventors' knowledge, no one to date has made a transparent bar using a synthetic detergent and a soap having the enhanced transparency, clarity, color and purity of the soaps described and claimed herein nor has anyone used the solubilation system described and claimed herein for cosmetic ingredients.

Further, U.S. Pat. Nos. 4,278,655 and 4,293,544 to *Elmi*, and 4,275,222, 4,322,545, 4,323,693, and 4,323,694, to *Scala, Jr.*, all assigned to Finetex, Inc., the Assignee herein, all described certain benzoic acid esters of primary alcohols of $C_9$ to $C_{18}$ carbon chain length. These esters are useful as diluents, solvents, plasticizers, liquid carriers, and the like, for cosmetic compositions. The entire disclosures of all of these patents are incorporated herein by reference.

Further, U.S. Pat. No. 3,741,911 to *Shane* describes certain alkyl-aryl polyoxyalkylene carboxylic acids and derivatives thereof for use as a surfactant in detergent compositions. The entire disclosure of this patent is incorporated herein by reference.

Applicant has discovered that when certain of these alkyl-aryl polyoxyalkylene carboxylic acids are utilized in conjunction with a combination of a synthetic detergent and a soap and, preferably, in conjunction with the aforementioned benzoic acid esters, that, surprisingly and unexpectedly, a truly transparent "combo-bar" is produced. Additionally, Applicants have also discovered that when these benzoic acid esters and alkyl-aryl polyoxyalkylene carboxylic acids are used, even without a synthetic detergent, these ingredients cause known transparent soap bars and liquids to have unexpected clarity. The combination may also be used as a solubilizer for cosmetic ingredients while maintaining clarity.

OBJECTS AND SUMMARY OF THE INVENTION

It is an object of this invention to provide a "combo-bar" containing a synthetic detergent which is transparent.

It is a further object of this invention to produce a transparent soap bar, in particular a "combo-bar" having enhanced transparency.

It is still a further object of this invention to provide methods for the preparation of such transparent "combo-bars", by both continuous and batch processes.

It is a further object of this invention to produce novel transparent soap bars having enhanced clarity and transparency.

Other objects and advantages will be apparent from the following detailed description of the invention.

The invention is directed to a transparent soap produced from:

(a) a water soluble organic solvent, up to about 10%;

(b) a sugar, up to about 10%;

(c) an alkyl-aryl polyoxyalkylene carboxylic acid of the formula:

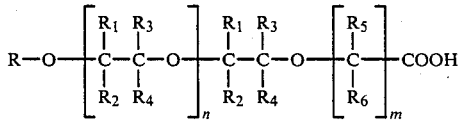

wherein R is either an aryl, alkyl-aryl or an alkyl radical, preferably alkyl-aryl. $R_1$ through $R_6$ are each hydrogen or a lower alkyl radical and may be the same or different (preferably all are hydrogen) and m is 1 to 3 and n is 1 to 9, about 1% to 10%;

(d) a benzoic acid ester of a primary alcohol or alkoxylate of a primary alcohol, said alcohol of $C_9$ to $C_{20}$ carbon chain length, up to about 5%;
(e) a water soluble synthetic organic detergent, up to about 25%;
(f) a neat soap, up to about 60%;
(g) a fatty acid, about 1% to about 25%; and
(h) a saponifying or neutralizing agent, acid, about 3% to about 35%;
(i) EDTA (ethylene diamine tetra-acetic acid) up to about 2%;
(j) water up to 25%.

The invention is further directed to batch or continuous methods of producing said transparent soap bar.

FIGURES

The only FIGURE herein is a schematic of a continuous process for the manufacture of the soap of this invention.

DETAILED DESCRIPTION OF THE INVENTION

The terminology "transparent" as used herein to described the products of this invention refer to a standard described by F. W. Wells in Soap and Chemical Specialties, Vol. XXI, No. 6 and No. 7, June and July 1955, which provides a criteria for transparency (in actuality translucency). A soap to be considered transparent, i.e. translucent, must permit bold faced type of about 14 point size to be read easily through a quarter-inch section of the soap. Other methods, for example "translucency voltage", have been employed to evaluate the transparency and translucency of soaps, see for example U.S. Pat. No. 2,970,116 to *Kelly et al.*, incorporated herein by reference. In actuality, transparency is the limit of translucency wherein no attenuation or loss of transmission occurs, and images viewed through a "transparent" material will appear as if the material were not there at all.

The transparent soap bar, i.e. "combo-bar", of this invention comprises a certain amount of a fatty acid soap. This fatty acid soap is produced by reacting a fatty acid of from about 1% to about 25% by weight of the dry bar, i.e. component (g), and an amount of a saponifying or neutralizing agent, i.e. about 3% to 35% by weight of the dry bar (component h). The fatty acid soap component is preferably an alkaline metal, alkaline earth metal, e.g. magnesium, ammonium or amine salt of $C_6$–$C_{22}$ fatty acids and mixtures thereof.

The fatty acids employed in making the soaps herein may contain about 6 to 22 or more, preferably, about 8 to 18 carbon atoms, may be of animal, vegetable, or synthetic origin, and may be saturated or unsaturated, and straight, mono- or poly-branched chain hydrocarbon carboxylic acids. As merely illustrative of such acids, there may be mentioned caproic, caprylic, capric, lauric, myristic, stearic, oleic, elaidic, isostearic, palmitic, undecylenic, tridecylenic, pentadecylenic, 2-lower alkyl higher alkanoic or other saturated or unsaturated fatty acids. Dicarboxylic acids may also be used, such as dimerized linoleic acid. Other higher molecular weight acids as rosin or tall oil acid, e.g. abietic acid, may be employed. Readily available commercial blends and mixtures of such blends which may be used include distilled palm and palm kernel oil fatty acids, distilled coconut oil fatty acids, hydrogenated tallow fatty acids, and commercial stearic acid. A preferred fatty acid used is a coco fatty acid blend of about 45% stearic acid and about 55% palmitic acid, called "a triple pressed acid".

For the in situ saponification of these fatty acids according to the process of this invention, there may be employed any alkaline metal -, alkaline earth metal -, ammonium -, or amine-salt forming base, as for example sodium, potassium, magnesium, or ammonium hydroxides, mono-, di- or triethanol-, or propanol- amines, or any other such base yielding a water-soluble salt or soap of the fatty acid being saponified. An approximately stoichiometric amount of base is preferably employed unless a product is desired containing slight amounts of excess fatty acid or base. Preferred bases are the lower alkanolamines, in particular triethanolamine and diethanolamine. Another preferred neutralizing agent for such fatty acids is N, N, N', N'-tetrakis (2-hydroxypropyl) ethylenediamine as sold by BASF under the name QUADROL, as described in the aforecited U.S. Pat. No. 4,290,904 to *Poper et al.*, the entire disclosure of which is incorporated herein by reference.

The transparent "combo-bar" of this invention preferably contains a water-soluble synthetic organic detergent. The bar may contain up to about 25% of synthetic detergent. As the synthetic detergent there may be employed many water-soluble synthetic organic detergent, or mixtures thereof, of the anionic sulfonate and sulfate and nonionic aliphatic and aromatic types, ample descriptions of which appear in McCutcheons' "Detergents and Emulsifiers", 1969 annual, and in "Surface Active Agents" by Schwartz, Perry and Berch, Vol. II 1958 (Inter-Science Publishers), which descriptions are incorporated herein by reference. Other synthetic detergents are described, for example, in U.S. Pat. No. 4,206,069 to *Borrello*, incorporated herein by reference.

Particularly preferred are the water-soluble anionic detergents, in particular the higher (e.g. $C_{10}$–$C_{20}$) acyl sarcosinates, acylisethionates and acyltaurides such as sodium lauroyl sarcosinate, the cocoyl fatty acid ester of isethionic acid, and sodium or potassium N-methyl-N-lauroyl or oleyl-taurides. These synthetic detergents contribute improved hard water solubility and improved detergency to the bar of this invention, particularly in hard water. Preferably, they should constitute up to about 25% of the "combo-bar" composition, most preferably up to about 12%.

A portion of the transparent bar of this invention should be a water soluble organic solvent up to about 10% by weight of the bar. A particularly suitable water soluble organic solvent is propylene glycol. Generally a monohydric or polyhydric alcohol, such as ethyl alcohol or 1,7-heptane-diol, respectively the mono- and polyethylene and -propylene glycols of up to about 4000 molecular weight, any mono-$C_{1-4}$ alkyl ethers thereof, sorbitol, glycerol, glucose, diglycerol, sucrose, lactose, dextrose, 2-pentanol, 1-butanol, mono-, di- and triethanolamine, 2-amino-1-butanol, and the like, especially the polyhydric alcohols.

Preferably, the transparent bars of this invention contain a combination of a water soluble organic solvent, such as glycerine, propylene glycol, or 1,3-butylene glycol, in combination with a sugar, such as sorbitol, glucose, or sucrose. It is particularly preferred to use glycerine in combination with sorbitol. The preferred amount of water soluble organic solvent is up to about 10% and used in combination with a sugar of up to about 10%.

In a soap of this invention, the most abundant material is usually a neat soap which is a soap initially containing from 28% to about 34% water, usually about 30% to 32% water, e.g. a neat kettle soap. The precise composition of the neat soap used to prepare the soap of this invention is not critical as long as the composition does not interfere with the transparency of the soap material and is typical of those ordinarily employed in the manufacture of toilet soaps. The preferred neat soap comprises a mixture of coconut oil and tallow soap with the predominant being tallow soap. Up to about 60% neat soap is contained in the transparent "combo-bar" of this invention, however, from 30% to 55% is the preferred range.

Applicants have discovered that a critical ingredient in maintaining the "combo-bar" of this invention transparent is the use of an alkyl-aryl polyoxyalkylene carboxylic acid of the formula:

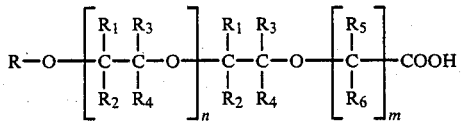

wherein R is either an aryl, alkyl-aryl or alkyl radical, $R_1$ through $R_6$ are each hydrogen or a lower alkyl radical and may be the same or different, m is 1 to 3 and n is 1 to 9, present at about 1% to 10% in the transparent bar. Preferably this compound is present in the range of 0.5% to 4% and most preferably about 2.5% of the transparent soap bar. The preferred compound of use is SURFINE AZI as sold by Finetex, Inc. which is a poly(oxy 1,2 ethandiyl) alpha-nonylphenol-omega-methyl carboxylic acid having the CTFA name of nonoxynol-10-carboxylic acid and having the formula:

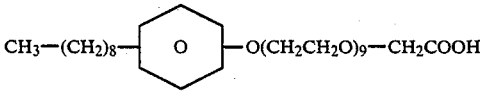

It has been found that when this composition is used in a "combo-bar" it produces a transparent bar heretofore unknown.

Additionally, Applicants have found that when the benzoic acid esters of primary alcohols in the range of $C_9$ to $C_{18}$ carbon chain length are added, up to about 5% by weight of the bar, the transparency of the "combo-bar" is further enhanced. These benzoic acid esters are described in the aforementioned U.S. Pat. Nos. 4,275,222, 4,278,655, 4,293,544, 4,322,545, 4,323,693 and 4,323,694 all assigned to the assignee herein, Finetex. Preferred benzoic acid esters are the benzoic acid esters of a mixture of $C_{12}$–$C_{15}$ linear primary alcohols sold under the trademark FINSOLV TN, and the benzoic acid ester of isostearyl ($C_{18}$) alcohol sold under the trademark FINISOLV SB, both of which are sold by Finetex. Additionally, the benzoic acid esters of alkoxylates of a primary alcohol of $C_9$ to $C_{18}$ may also be used. These are described in copending application U.S. Ser. No. 07/023,767, entitled "Benzoic Acid Esters" to *Walele et al.* The entire disclosure of this application is incorporated herein by reference.

A preferred transparent "combo-bar" of this invention is made from about 4% to 5% glycerine, 25% to 30% triethanolamine, 2% to 6% sorbitol, 1% to 4% SURFINE AZI, 1% to 4% FINSOLV TN, 7% to 12% sodium cocyl isethionate, 35% to 45% neat soap and 7% to 10% of a fatty acid blend.

Numerous well known methods may be utilized for manufacturing the transparent soaps of this invention. Applicants' preferred batch methods of producing this soap comprise admixing all of the components, heating the admixture until molten, reacted and homogeneous, and then casting and cooling to solidification.

Another batch method of producing the transparent bars of this invention is:

(i) admixing components (a) through (d) and (h);
(ii) heating the admixture, to the molten temperature of the bar;
(iii) admixing component (e) therein;
(iv) admixing component (f) therein;
(v) admixing component (g) therein;
(vi) casting; and
(vii) cooling to solidification.

Still another batch method of preparing the transparent bars of this invention is:

(i) admixing components (f), (g), (c) to form an admixture;
(ii) heating to molten;
(iii) neutralizing with component (h);
(iv) admixing components (a), (b), (d), (e);
(v) casting; and
(vi) cooling to solidification.

A continuous method of producing the bars of this invention is:

(i) preparing a first mixture of component (a) through component (d) and (h);
(ii) preparing a second mixture of component (e) and component (g);
(iii) continuously proportioning and mixing the first mixture with component (f) to produce a third mixture;
(iv) continuously proportioning and mixing said third mixture with said second mixture to produce a fourth mixture;
(v) casting said fourth mixture; and then
(vi) cooling said fourth mixture to solidification;
(vii) maintaining the temperature in steps (i) through (v) to maintain the mixtures in a molten condition.

Attached hereto as the FIGURE in this specification is a process chart describing this process.

The following examples illustrate the transparent bars of this invention, their process of manufacture and their use thereof. Unless otherwise indicated, all parts are by weight, and when by weight of the bar, it is the finished weight of the bar. All temperatures are in °C.

The final bar of this invention will usually contain about 10% to about 15% water. Additional material such as preservatives, antioxidents, colorants and perfumes can also be used in their usual proportions and for their usual effect.

The transparent bar of this invention has unusual glass-like clarity, is essentially water-white color, has enhanced stability to light, heat, oxygen and hard water and has superior foaming qualities. The bar is a low moisture bar comparable to machined, i.e. opaque, soap bars and has low sloughing and wear rate. The bar does not use alcohol to aid in achieving transparency. Further, the unique solubilization system of this invention provides for the delivery of other cosmetic materials and benefits, such as *emolliency*, sun protection, frangance and others, while maintaining clarity of the bar and superior afterfeel. The system may also be produced in liquid form.

EXAMPLES

The following are examples of preferred components and procedures for making the transparent "combo-bars" of this invention.

Formulation

The formulations given below differ in the "neat soap" component; that is, in Formulation I, neat soap is a previously produced, singularly considered component. Formulation II is based on in-situ preparation of neat soap from its reactants.

| Component | I (wt %) | II (wt %) |
|---|---|---|
| 1. Glycerine, 99% USP | 3.53 | 3.53 |
| 2. Sorbitol, 70% | 3.93 | 3.93 |
| 3. Triethanolamine, 99% | 27.50 | 27.50 |
| 4. SURFINE AZI-A | 2.50 | 2.50 |
| 5. FINSOLV TN* or FINSOLV SB* | 2.00 | 2.00 |
| 6. TAURANOL I-78 | 10.00 | 10.00 |
| 7. Neat Soap[1] | 42.14 | — |
| 8. Tallow/Coco Fatty Acid Blend (Toilet Soap Grade)[2] | — | 26.55 |
| 9. Stearic/Coco Fatty Acid Blend[3] | 8.50 | 8.50 |
| 10. NaOH (25.9%, Sp. Gr = 1.284) | — | 15.59 |
| 11. NaCl | — | 0.21 |

[1]Note: Preferably derived from fatty acids.
[2]Recommended: Emery 515 or 516 Hystrene 1835 P&G TC1010 or TC1005
[3]Recommended: 1:1 wt:wt blend of Emersol 132 & Emery 627, or equivalents

Procedures

Formulation I (from neat soap)

1. Combine the liquids (1–5). Heat with stirring (preferably under $N_2$) to 70°–75° C. (A prismatic effect will be seen at 55° C.).
2. Add the TAURANOL I-78 (#6); maintain temperature and $N_2$ purge until the powder is dissolved.
3. Add the neat soap (#7) in increments, maintaining the temperature. Pre-mix and melt the stearic/coco fatty acids. Do not exceed 60° C.
4. Add the molten fatty acid blend (#9) to the bulk; stir (under $N_2$) for a minimum of 30 minutes. Maintain temperature at a maximum of 70° C.
5. Adjust moisture (mass balance) and incorporate. Allow mass to remain quiescent at max. 75° C. until deaerated. Strain through cheesecloth and/or decant into molds. Cool to room temperature. *Do not quick chill.*

Formulation II (in situ neat soap formation)

1. Charge the tallow/coco fatty acid blend (#8). Heat to 59°–62° C. (max.). Add the SURFINE AZI-A (#4) and incorporate at temperature.
2. Dissolve the NaCl (#11) in the NaOH solution.
3. Add, in a continuous stream, the NaOH/NaCl solution. The system will undergo a number of phase changes: emulsification, gellation, fluid (high viscosity). Note: This reaction is exothermic, and the mass will reach a temperature of about 95° C. Continue mixing as it cools to 75° C. (max) before proceeding. At this point the "neat soap" should be slightly alkaline to phenolphtalin.
4. Under $N_2$, add the other liquids (1,2,3 & 5). Thoroughly incorporate at 70°–75° C.
5. Add the TAURANOL I-78 (#6) in increments and stir at 70°–75° C. until dissolved.
6. Add the pre-mixed, pre-molten fatty acid blend (#9), stir for a minimum of 30 minutes. Maintain temperature at a maximum of 70° C.
7. Adjust moisture (mass balance) and incorporate. Allow mass to remain quiescent at max. 75° C. until deaerated. Strain through cheesecloth and/or decant into molds. Cool to room temperature. *Do not quick chill.*

In a similar manner, the following transparent "combo-bars" were made by the following procedure:

Method of Prepration (A)

1. Combine components from a, b, c, d, h.
2. Heat with stirring to 75° C.
3. Add (e) in increments at 75° C. until dissolved.
4. Add (f) in increments at 75° C. until dissolved.
5. Add pre-molten (g) at 75° C. Adjust moisture.
6. Cast and cool.

Method of Preparation (B)

1. Prepare a premix composition of (a), (c), (d), (e) and a stoichiometric amount of (h) to form a premix.
2. Combine the remainder of (h) and (b). Add the proportionate amount of the premix.
3. Proceed as 4–6 above.

| Component | | Claim Limit (%) | A | B | C | D | E | F | G | H | I | J | K | L | M | N | O | P |
|---|---|---|---|---|---|---|---|---|---|---|---|---|---|---|---|---|---|---|
| Glycerin, 99% | a | to 10 | 3.53 | — | 4.5 | 5.0 | 3.53 | 3.53 | 3.53 | 3.53 | 3.53 | 3.81 | 3.53 | 3.53 | 3.53 | 3.53 | 2.65 | 3.53 |
| Propylene Glycol | a | to 10 | — | 3.53 | — | | — | — | | | | | | | | | | |
| Sorbitol, 70% | b | to 10 | 3.93 | 3.93 | 3.9 | 4.0 | 3.93 | 3.93 | 3.93 | 3.93 | 3.93 | 3.93 | 3.93 | 3.93 | 3.93 | 3.93 | 2.95 | 3.93 |
| SURFINE AZI-A | c | 1–10 | 2.5 | 2.5 | 3.5 | 4.0 | 2.50 | 2.50 | — | 2.50 | 2.50 | 2.50 | — | 2.50 | 2.50 | 2.50 | 1.88 | 2.50 |
| SURFINE WNT | c | 1–10 | — | — | — | — | — | — | 2.50 | — | — | — | — | — | — | | | |
| FINSOLV TN | d | to 5 | 2.0 | 2.0 | — | 2.0 | — | — | 2.00 | 2.00 | 2.00 | 2.00 | 2.00 | 2.00 | — | 2.00 | 1.50 | 2.00 |
| FINSOLV SB | d | to 5 | — | | — | | 2.00 | | — | — | — | — | — | — | — | — | — | |
| FINSOLV D | d | to 5 | — | | — | | — | 2.00 | — | — | — | — | — | — | — | — | — | |
| Butyl Benzoate | d | to 5 | — | — | — | — | — | — | — | — | — | — | — | — | 2.00 | — | — | |
| TAURANOL I-78 | e | to 25 | 10.00 | 10.00 | 8.0 | 10.0 | 10.00 | 10.00 | 10.00 | 10.00 | 10.00 | 10.00 | 10.00 | 10.00 | 10.00 | 10.00 | 7.50 | 10.00 |
| Neat Soap | f | to 60 | 42.14 | 42.14 | 43.0 | 45.00 | 42.14 | 42.14 | 42.14 | 42.14 | 42.14 | 42.14 | 44.64 | 42.14 | 42.14 | 42.14 | 31.49 | — |
| Hystrene 1835 | g | 1–25 | — | — | — | — | — | — | — | — | — | — | — | — | — | — | — | 26.55 |
| Emersol 132 | g | 1–25 | 4.20 | 4.20 | 4.20 | 4.20 | 4.20 | 4.20 | 4.20 | 4.20 | 4.20 | 4.20 | 4.20 | 4.20 | 4.20 | — | 3.20 | 4.20 |
| Emersol 627 | g | 1–25 | 4.20 | 4.20 | 4.20 | 4.20 | 4.20 | 4.20 | 4.20 | — | — | 4.20 | 4.20 | 4.20 | 4.20 | — | 3.20 | 4.20 |
| Emersol 629 | g | 1–25 | — | | | | | | | 4.20 | — | — | — | — | — | — | — | |
| Austerene 5012 | g | 1–25 | | | | | | | | | 4.20 | — | — | — | — | — | — | |
| Oleic Acid | g | 1–25 | | | | | | | | | | | | | | 8.40 | — | |
| Triethanolamine | h | 3–35 | 27.50 | 27.50 | 27.70 | — | 27.50 | 27.50 | 27.50 | 27.50 | 27.50 | 13.75 | 27.50 | 26.50 | 27.50 | 27.50 | 20.63 | 27.50* |
| Diethanolamine | h | 3–35 | — | — | — | 19.40 | — | — | — | — | — | — | — | | — | — | — | — |
| QUADROL | h | 3–35 | — | — | — | — | — | — | — | — | — | 13.47 | — | — | — | — | — | — |
| EDTA | i | to 2 | — | — | — | — | — | — | — | — | — | — | — | 1.00 | — | — | — | — |
| Water | j | to 25 | — | — | 1.00 | 2.20 | — | — | — | — | — | — | — | — | — | — | 25.00 | — |
| NaOH solution, 25.9% | | | — | — | — | — | — | — | — | — | — | — | — | — | — | — | — | 15.59 |

*or other comparable 80/20 fatty acid blends for soap (Preparation C)

The formulations demonstrate the following:

| Formula | Demonstrates | Clarity* |
|---|---|---|
| A | Preferred composition | 10.0 |
| B | Use of Propylene Glycol replacing glycerine | 9.5+ |
| C | Absence of benzoate (FINSOLV TN) | 9.5+ |
| D | Use of DEA in place of TEA | 8.0 |
| E | Substitution of benzoate (FINSOLV SB for FINSOLV TN) | 10.0 |
| F | Substitution of benzoate (Stearyl Propoxy for FINSOLV TN) | 10.0 |
| G | Substitution of alkyl carboxylate | 9.0 |
| H | Change in fatty acids | 9.0+ |
| I | Change in fatty acids | 8.5+ |
| J | Use of QUADROL (½) | 9.0 |
| K | Absence of alkyl carboxylate | 1.0 |
| L | Use of EDTA | 10.0 |
| M | Use of benzoate outside of claim (low carbon) | 1.0 |
| N | Use of liquid fatty acid (oleic acid) | 9.5+ |
| O | Liquid, clear formulation (uses $H_2O$) | 10.0 |

*CLARITY: 10 = highest clarity 1 = opaque

What is claimed is:

1. A transparent soap bar containing soap and a water soluble synthetic detergent comprising:

(a) a water soluble organic solvent, about 0 to 10%;

(b) a sugar, about 0 to 10%;

(c) and alkyl-aryl polyoxyalkylene carboxylic acid of the formula:

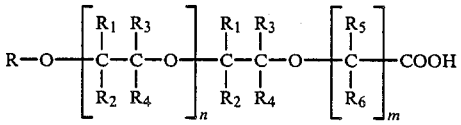

wherein R is an aryl, alkyl-aryl or alkyl radical, $R_1$ through $R_6$ are each hydrogen or a lower alkyl radical and may be the same or different, m is 1 to 3 and n is 1 to 9, about 1% to 10%;

(d) a benzoic acid ester of a primary alcohol or an alkyoxylate of a primary alcohol, said alcohol of $C_9$ to $C_{18}$ carbon chain length, about 0 to 5%;

(e) an amount of a water soluble synthetic organic detergent, up to about 25%;

(f) a neat soap, about 0 to 60%;

(g) a fatty acid, about 1% to about 25%;

(h) a saponifying or neutralizing agent for the fatty acid, about 3% to about 35%;

(i) ethylene diamine tetra-acetic acid, about 0 to 2%; and (j) water, about 0 to 25%.

2. The soap of claim 1, wherein component (a) is glycerine, propylene glycol, or 1,3 butylene glycol.

3. The soap of claim 1, wherein component (a) is glycerine.

4. The soap of claim 1, wherein component (b) is sorbitol, glucose, or sucrose.

5. The soap of claim 1, wherein component (b) is sorbitol.

6. The soap of claim 1, wherein component (c) is poly(oxy 1,2 ethanediyl)alpha-nonylphenol omega-methyl carboxylic acid.

7. The soap of claim 1, wherein component (d) is a benzoic acid ester of a mixture of $C_{12}$–$C_{15}$ linear primary alcohols.

8. The soap of claim 1, wherein component (f) is sodium cocoyl isethionate.

9. The soap of claim 1, wherein component (h) is a lower alkanolamine.

10. The soap of claim 1, wherein component (h) is triethanolamine.

11. A transparent "combo-bar" produced from:

(a) glycerine, about 4% to 5%;

(b) sorbitol, about 2% to 6%;

(c) poly(oxy 1,2 ethanediyl) alpha-nonylphenol omega methyl carboxylic acid, about 1% to 4%;

(d) benzoic acid esters of a mixture of $C_{12}$–$C_{15}$ linear primary alcohols, about 1% to 4%;

(e) sodium cocoyl isethionate, about 7% to 12%;

(f) neat soap, about 35% to 45%;

(g) fatty acid blend, about 7% to 10%;

(h) triethanolamine, about 25% to 30%;

(i) ethylene diamine tetra-acetic acid, about 0 to 2%; and (j) water, about 0 to 25%.

12. A process of making the soap of claim 1 comprising admixing components (a) through (h), heating the admixture until molten and homogeneous, and then casting and cooling said admixture.

13. A process for producing the soap of claim 1 comprising:

(i) admixing components (a) through (d) and (h);

(ii) heating the admixture, to a temperature to dissolve (e);

(iii) admixing component (e) therein to dissolution;

(iv) admixing component (f) therein;

(v) admixing component (g) therein;

(vi) casting; and (vii) cooling to solidification.

14. A process for producing the soap of claim 1, comprising:

(i) admixing components (f), (g), (c) to form an admixture;

(ii) heating until molten;

(iii) neutralizing with component (h);

(iv) admixing components (a), (b), (d), (e);

(v) casting; and (vi) cooling to solidification.

15. A continuous process for making the transparent soap of claim 1, comprising:

(i) preparing a first mixture of component (a) through component (d) and (h);

(ii) preparing a second mixture of component (e) and component (g);

(iii) continuously mixing the first mixture with component (f) to produce a third mixture;

(iv) continuously mixing said third mixture with said second mixture to produce a fourth mixture;

(v) casting said fourth mixture; and then (vi) cooling said fourth mixture to solidification;

(vii) maintaining the temperature in steps (i) through (v) to maintain the mixtures in a molten condition.

16. A method of enhancing the transparency of a soap bar containing soap and a water soluble synthetic detergent comprising incorporating in said soap bar a transparency enhancing amount of an alkyl-aryl polyoxyalkylene carboxylic acid of the formula:

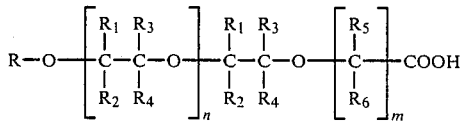

wherein R is an aryl, alkyl-aryl or alkyl radical, $R_1$ through $R_6$ are each hydrogen or a lower alkyl radical and may be the same or different, m is 1 to 3 and n is 1 to 9.

17. The method of claim 16, wherein the alkyl-aryl polyoxyalkylene carboxylic acid is poly(oxy 1,2 ethanediyl) alphanonylphenol omega-methyl carboxylic acid.

18. The method of claim 16, further comprising incorporating therein a transparency enhancing amount of a benzoic acid ester of a primary alcohol of $C_9$ to $C_{18}$ carbon chain length.

19. The method of claim 18, wherein the benzoic acid ester is a benzoic acid ester of a mixture $C_{12}$–$C_{15}$ linear primary alcohols.

20. A composition containing a water soluble synthetic detergent comprising:

(a) a water soluble organic solvent, about 0 to 10%;

(b) an alkyl-aryl polyoxyalkylene carboxylic acid of the formula:

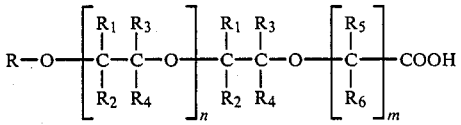

wherein R is an aryl, alkyl-aryl or alkyl radical, $R_1$ through $R_6$ are each hydrogen or a lower alkyl radical and may be the same or different, m is 1 to 3 and n is 1 to 9, about 1% to 10%;

(c) a benzoic acid ester of a primary alcohol or an alkoxylate of a primary alcohol, said alcohol of $C_9$ to $C_{18}$ carbon chain length, about 0 to 5%;

(d) the water soluble synthetic organic detergent, up to about 25%; and (e) a saponifying or neutralizing agent for a fatty acid, about 3% to about 35%.

21. A premix composition comprising:

(a) glycerine, about 4% to 5%;

(b) poly(oxy 1,2 ethanediyl) alpha-nonylphenol omega-methyl carboxylic acid, about 1% to 4%;

(c) benzoic acid ester of a mixture of $C_{12}$–$C_{15}$ linear primary alcohols, about 1% to 4%;

(d) sodium cocoyl isethionate, about 7% to 12%; and (e) triethanolamine, about 25% to 30%.

* * * * *